US005617788A

United States Patent [19]

Horiguchi et al.

[11] Patent Number: 5,617,788

[45] Date of Patent: Apr. 8, 1997

[54] SWITCHING TYPE CONTINUOUSLY OPERATIVE PRINTING MACHINE

[75] Inventors: Takeshi Horiguchi, Ebina; Satoru Sasaki, Yamato; Hideaki Miyake, Kanagawa-ken, all of Japan

[73] Assignee: Toshiba Kikai Kabushiki Kaisha, Tokyo, Japan

[21] Appl. No.: 635,005

[22] Filed: Apr. 19, 1996

Related U.S. Application Data

[63] Continuation of Ser. No. 541,428, Oct. 10, 1995, abandoned, which is a continuation of Ser. No. 242,101, May 13, 1994, abandoned.

[30] Foreign Application Priority Data

May 14, 1993 [JP] Japan ..... 5-112903

[51] Int. Cl.[6] ..... B41F 5/06; B41F 13/12

[52] U.S. Cl. ..... 101/181; 101/228

[58] Field of Search ..... 101/181, 183, 101/219, 220, 228, 178, 179, 180–185, 136–140

[56] References Cited

U.S. PATENT DOCUMENTS 4,240,346 12/1980 Landis et al. .
4,353,299 10/1982 Murai et al. .
5,109,770 5/1992 Uribe et al. .
5,117,753 6/1992 Mamberer ..... 101/181
5,341,735 8/1994 Hajek ..... 101/181

FOREIGN PATENT DOCUMENTS 2753433 5/1979 Germany ..... 101/181

*Primary Examiner*—J. Reed Fisher
*Attorney, Agent, or Firm*—Cushman Darby & Cushman, IP Group of Pillsbury Madison & Sutro, LLP

[57] ABSTRACT

A continuously operative printing machine and a method of operating the same are disclosed. The printing machine has a plurality of switchable printing units to be used selectively by switching. For continuous printing the printing units are switched alternately by coupling and decoupling first coupling/decoupling means while a continuous printing web is held running. Plate change of stationary printing units is done with independent drive means to be ready for the next printing. Then the stationary printing units are restored to the printing state through synchronous control by rotational control means. Thus plate change printing or the like can be carried out continuously without stopping the printing machine. In addition, high quality printing can be obtained efficiently. Further, it is possible to obtain double side printing.

8 Claims, 5 Drawing Sheets

SWITCHING TYPE CONTINUOUSLY OPERATIVE PRINTING MACHINE

This is a continuation of Application Ser. No. 08/541,428, filed on Oct. 10, 1995, now abandoned, which was abandoned upon the filing hereof which was a FWC of U.S. Pat. No. 08/242,101 filed May 13, 1994, now abandoned.

BACKGROUND OF THE INVENTION

1. Field of the Invention

This invention relates to a switching type continuously effective printing machine and a method of operating the same, which are applicable for shop name changes or the like in commercial printing of newspaper insert leaflets, direct mails, etc. with off-set rotary presses.

2. Description of the Related Art

Heretofore, in the commercial printing of newspaper insert leaflets and handbills, direct mails, catalogs, etc. with offset rotary presses, usually only character spot shop names, dates, prices, etc. are changed while leaving photographic processes or the like without alteration.

Such plate change printing is done by stopping the off-set rotary press, changing only the shop name plate, etc., and then operating the printing press again for duty service.

In addition to such plate change printing method, in which the off-set rotary press is once stopped, there is another plate change printing method, in which an in-printer (continuous printer) is connected to the off-set rotary press for carrying out the plate change printing without stopping the off-set rotary press. FIG. 6 shows an off-set rotary press 930, to which an in-printer 910 is connected.

Shown on the left side in the Figure is an in-feeder 902 for feeding out a continuous printing web 901. Shown on the right side of the Figure is a first color printing unit 931 of a multi-color off-set rotary press 930. An in-printer 910 is installed between the in-feeder 902 and the printing unit 931.

The in-printer 910 internally includes a common pressure cylinder 911, two printing cylinders 912 and 913 disposed above and below the pressure cylinder 911, and inking mechanisms 914 and 915 disposed above and below the plate cylinders 912 and 913 and each having a plurality of ink rollers rotated in contact with one another.

The printing plates of the plate cylinders 912 and 913 are flexographic plates (i.e., relief printing plates made of rubber, a resin, etc.). They are adapted to be secured by double-side adhesive tape, adhesive, etc. to the individual plate cylinders 912 and 913 at plate change positions thereof.

With such off-set rotary press 930 with the in-printer 910 connected thereto, the continuous printing web 901 fed from the in-feeder 902 is pinched between the common pressure cylinder 911 and one of the plate cylinders (for instance plate cylinder 912) for printing a shop name or the like.

During the printing with the printing cylinder 912, plate change of the other printing cylinder 913 is made to make the printing cylinder 913 ready for printing.

Subsequently, the printing cylinder 913 is started to switch the printing cylinders 913 and 912 and have the printing cylinder 913 in a printing state, while stopping the printing cylinder 912 for the next plate change.

After plate change Printing of a shop name or the like has been carded out with the in-printer 910 in this way, the continuous printing web is fed to the downstream off-set rotary press 930 for multi-color printing with plate cylinders 932 and blanket cylinders 933 provided in the off-set rotary press.

However, in the above method, in which the off-set rotary press is once stopped, the plate change operation which is carded out after stopping the press leads to a loss time. In addition, since the off-set rotary press is once stopped, restoration to the printing state requires a time. Therefore, the printing efficiency is inferior.

Further, since the off-set rotary press is once stopped, a great deal of paper loss is inevitable, thus increasing the printing cost.

In the above method, in which the in-printer 910 shown in FIG. 6 is connected, the plate change operation can be carried out without stopping the off-set rotary press 930. In this case, however, it is possible to obtain only single side printing.

The in-printer 910 is an exclusive priming machine for plate change printing of shop names or the like and has no other printing purpose. Therefore, it lacks versatility.

Moreover, since the printing plates of the individual printing cylinders 912 and 913 of the in-printer 910 are flexographic plates, equipment for producing flexographic plates is necessary, thus leading to added cost. Besides, the printing with the flexographic plate is inferior in quality to the printing with the off-set lithographic plate.

An object of the invention is to provide a continuously operative printing machine and a method of operating the same, which permit continuous plate change printing without stopping the printing machine, as well as permitting efficient high quality priming and also double-side printing.

SUMMARY OF THE INVENTION

To attain the above object of the invention, the printing machine comprises two or more switchable printing units which are switched adequately with individual switching means to be described later to obtain continuous operation.

More specifically, according to the invention there is provided a switching type continuously operative printing machine, which comprises a plurality of printing units and collective drive means for collectively driving the plurality of printing units, two or more of the plurality of printing units being switchable printing units to be switched for selective use, the switchable printing units each including first coupling/decoupling means for coupling and decoupling the collective drive means and each of them, independent drive means for independently driving each of them, second coupling/decoupling means for coupling and decoupling the independent drive means and each of them, and rotational control means for synchronizing the independent drive means and the collective drive means to one another at a predetermined speed.

According to the invention, there is also provided a switching type continuously operative printing machine, in which each of the first coupling/decoupling means is a onepoint clutch provided on a portion of the drive torque transmission path extending from the collective drive means to each printing unit that is rotated at the same rotational number as the rotational number of printing cylinders, the one-point clutch being capable of being coupled at a predetermined phase.

According to the invention, there is further provided a switching type continuously operative printing machine, in which the switchable printing units each includes two, i.e., an upper and a lower, blanket cylinders disposed in a staggered fashion with respect to the direction of progress of a continuous printing web such as to pinch the web, with guide rollers provided upstream and downstream the positions of disposition of the blanket rollers, the continuous printing web being directed by the guide rollers in a direction substantially perpendicular to a line connecting the centers of the two blanket cylinders.

According to the invention, there is still further provided a switching type continuously operative printing machine, in which the guide rollers are capable of being switched between a bent web passage disposition, in which the continuous printing web is passed to be directed in a direction substantially perpendicular to a line connecting the centers of the two blanket cylinders, and a straight web passage disposition, in which the continuous printing web is passed between the two blanket cylinders such that printing positions provided by the blanket cylinders of adjacent printing units are connected straight, the difference between the length of the pass of the web in the bent web passage disposition of the guide rollers and the length of the pass of the web in the straight web passage disposition of the guide rollers being a length corresponding to one excursion along the outer periphery of the printing cylinder.

According to the invention, there is yet further provided a switching type continuously operative printing machine, in which the guide rollers are capable of being switched between a bent web passage disposition, in which the continuous Printing web is passed to be directed in a direction substantially perpendicular to a line connecting the centers of the to blanket cylinders, and a straight web passage disposition, in which the continuous printing web is passed between the two blanket cylinders such that printing positions provided by the blanket cylinders of adjacent printing units are connected straight, phase adjustment means being provided on an intermediate position of the drive torque transmission path from the collective drive means to each switchable priming unit, the phase adjustment means being for adjusting the phase different between the printing cylinders when the guide rollers are in the bent web passage disposition and in the straight web passage disposition.

According to the invention, there is further provided a method of operating the switching type continuously operative printing machine noted above, which comprises the steps of carrying out printing by using selected ones of two or more switchable printing units while holding the other switchable printing units stationary, subsequently starting the stationary switchable printing units to a printing state while a continuous printing web is held in a running state, and carrying out continuous printing with switching of the switching Printing units by stopping switchable printing units in selective use.

According to the invention, there is further provided a method of operating the switching type continuously operative printing machine noted above, in which an operation of plate change with the stationary switchable printing units not in use for printing is done while the continuous printing web is in a running state to be ready for printing after the switching.

According to the invention, there is further provided a method of operating the switching type continuously operative printing machine noted above, in which for carrying out continuous printing by switching the switchable printing units guide rollers provided upstream and downstream the positions of blanket cylinders in each switchable printing unit are switched to a bent web passage disposition, in which a continuous printing web is passed to be pinched such that it is directed in a direction substantially perpendicular to a line connecting the centers of two, i.e., an upper and a lower, blanket cylinders disposed in a staggered fashion with respect to the direction of progress of the web, and for carrying out printing by using all the switchable printing units the guide rollers are switched to a straight web passage disposition, in which the continuous printing web is passed such that printing positions provided by the blanket cylinders of adjacent printing units are connected straight.

According to the invention as above, plate change printing of a shop name or the like is effected without stopping the printing machine but by suitably switching two or more switchable printing units while the continuous printing web is held running.

At this time, the switchable printing units that are selected for use and the collective drive means are connected to one another by switching the first coupling/decoupling means for each printing unit to a coupling state and are driven for rotation by the collective drive means to a printing state, while the switchable printing units that are not selected for use are disconnected from the collective drive means by switching the coupling/decoupling means for each of these printing units to a decoupling state.

During the printing with the selected printing units the non-selected printing units are held stationary. During this time, plate change of each non-selected printing unit is done for the next printing by rotating the non-selected printing unit with the independent drive means therefor by switching the second coupling/decoupling means for the non-selected printing unit to a coupling state.

When it becomes necessary to change a plate of a shop name or the like, the states of the selected printing units that are in use and the non-selected printing units that are held stationary and out of use are interchanged by switching their first coupling/decoupling means.

When switching the switchable printing units, the independent drive means for the stationary printing units are controlled by the rotational control means to synchronize the stationary printing units to the printing units in use at a printing speed. When the synchronization is completed, the first cooping/decoupling means for the stationary printing units are switched form the decoupled state to the coupled state to restore the stationary printing units to the printing state. Meanwhile, the selected printing units in use are disconnected from the collective drive means and stopped by switching their first coupling/decoupling means to the decoupled state.

With the one-point clutch used as the first coupling/decoupling means, when restoring the stationary printing units to the printing state the phase adjustment can be readily made.

Further, for continuous printing by switching the printing units (i.e., plate change printing with the continuous printing web held running), the guide rollers provided upstream and downstream blanket cylinders are switched to a disposition, in which the continuous printing web pinched between the two blanket cylinders is guided by the guide rollers in a direction substantially perpendicular to a line connecting the centers of the blanket cylinders. By so doing, it is possible to prevent the contact of the continuous printing web and the blanket cylinders when switching the blanket cylinders to a straight web passage disposition while the continuous priming web is held running for the plate change operation.

The guide rollers can be switched between a bent web passage disposition, in which the continuous printing web is passed such as to be directed in a direction substantially perpendicular to a line connecting the centers of the two blanket cylinders, and a straight web passage disposition, in which the web is passed such that printing positions provided by the blanket cylinders of adjacent printing units are connected straight.

Thus, by passing the continuous printing web in the usual straight web passage, it is possible to obtain printing by using all the printing units instead of the plate change printing by switching the printing units.

in the switching between the bent web passage and straight web passage, it is necessary to have the printing cylinders of the individual printing units in phase. However, by setting the difference between the length of the pass of the continuous printing web passed by the bent web passage and the length of the web passed by the straight web passage to be a length corresponding to one excursion along the outer periphery of the printing cylinder, the switching between the bent web passage and straight web passage may be made without need of any phase adjustment.

If it is impossible to secure the length corresponding to one excursion along the outer periphery of the printing cylinder, phase adjustment means may be provided for adjusting the phase difference at the time of the switching between the bent web passage and the straight web passage.

The object of the invention noted above is attained by the switching type continuously operative printing machine having the above various means and the method of operating the same printing machine.

DETAILED DESCRIPTION OF THE PREFERRED EMBODIMENT(S)

Now, an embodiment of the invention will be described with reference to the drawings.

Figure 1:
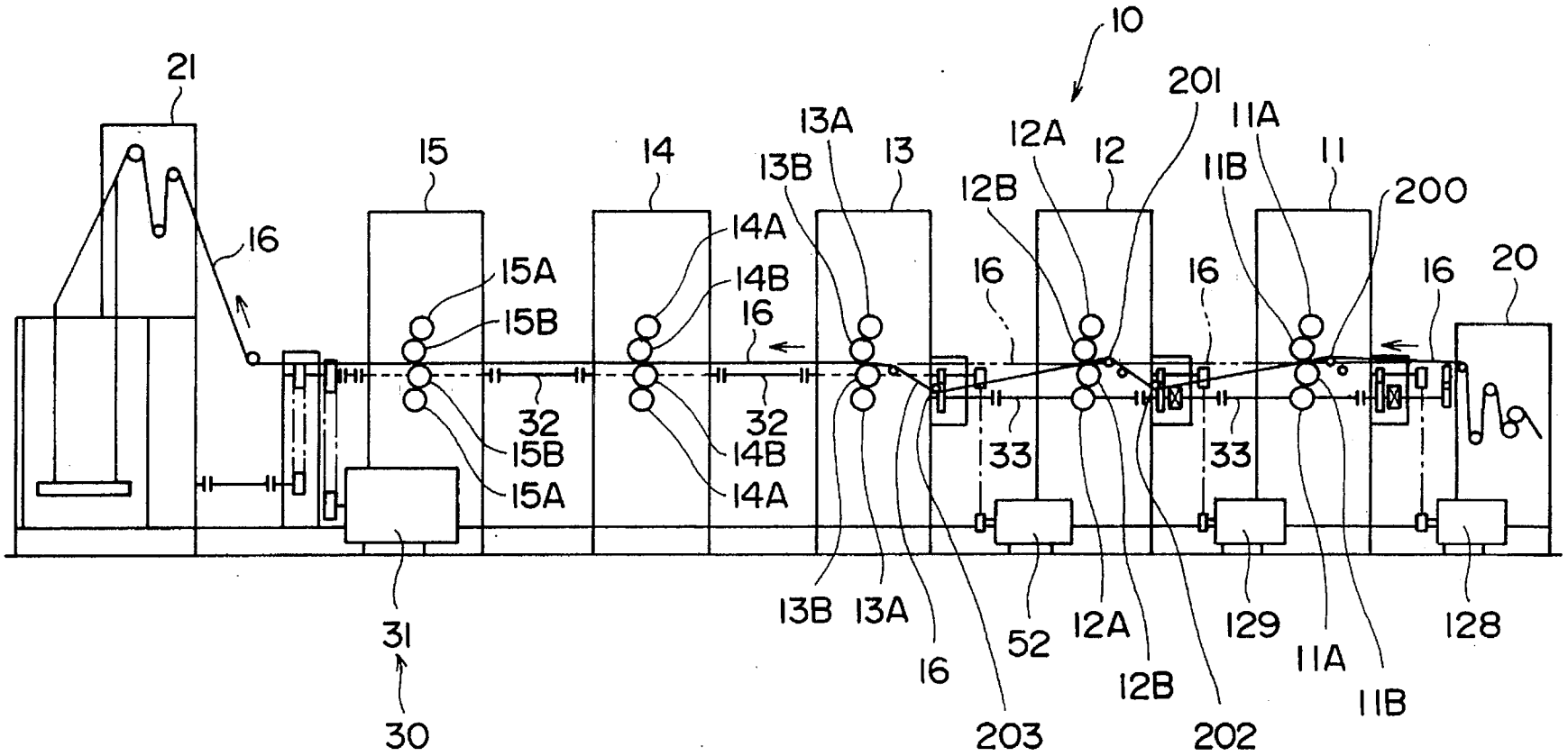
FIG. 1 is a schematic view showing an embodiment of the invention.

FIG. 1 shows the overall construction of a multi-color off-set rotary press as an embodiment of the switching type continuously operative priming machine according to the invention.

The off-set rotary press 10 has five printing units 11 to 15 as shown from the right side in FIG. 1. A printing web (continuous printing web) 16 is passed through the individual printing units 11 to 15. The individual printing units 11 to 15 internally include printing cylinders 11A to 15A with printing plates thereon and blanket cylinders 11B to 15B for effecting printing on the web 16 with ink transferred from the plate cylinders 11A to 15A.

On the right side (upstream side) of the off-set rotary press 10 in FIG. 1, a web feeder 20 is provided for feeding out the web 16 before printing to the printing unit 11. 0n the left side (downstream side) of the off-set rotary press 10 in FIG. 1, a folding/cutting unit 21 is provided for suitably folding or cutting the web 16 fed after printing in the printing unit 15.

On the left side of the printing unit 15 in FIG. 1, a main motor 31 is provided for collectively driving the printing units 11 to 15. The printing units 13 to 15 are coupled to a main line shaft 32. The printing units 11 and 12 are coupled to a sub-line shaft 33, which is connected to the Main line shaft 32 between the printing units 12 and 13.

The main motor 31, main line shaft 32 and sub-line shaft 33 form a collective drive means 30. In the collective drive means 30 the main motor 31 drives the main line and subline shafts 32 and 33 for rotation to cause synchronous rotation of the printing cylinders 11A to 15A in the printing units 11 to 15.

Figure 2:
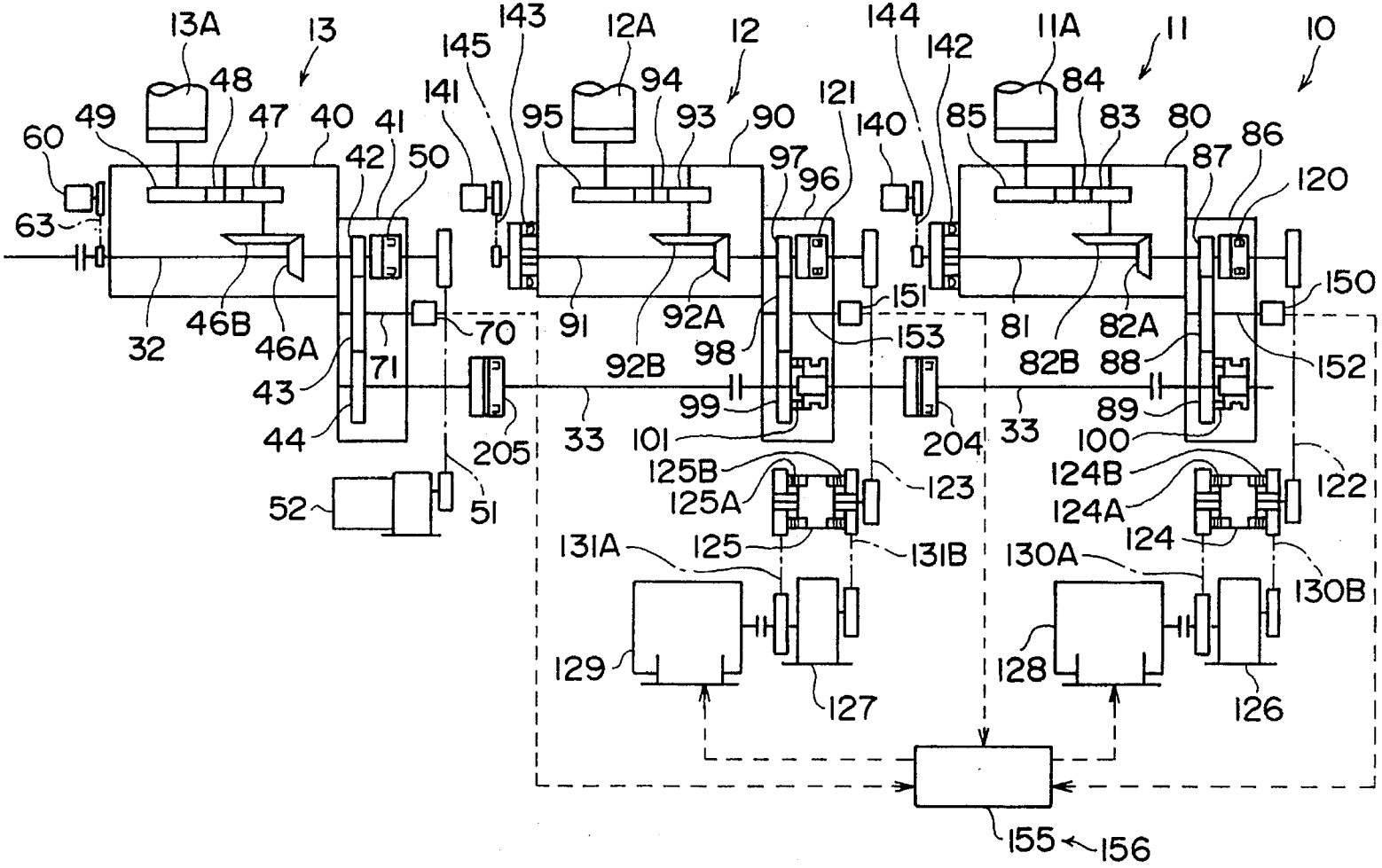
FIG. 2 is a schematic view showing an essential part of the same embodiment.

FIG. 2 shows a drive mechanism for each of the printing units 11 to 13.

The printing unit 13 on the left side in FIG. 2 has a drive side frame 40 provided with a gear box 41. In the gear box 41, the main line and sub-line shafts 32 and 33 are connected together.

The gear box 41 accommodates a gear 42 secured to the main line shaft 32, a gear 43 in mesh with the gear 42 and a gear 44 in mesh with the gear 43 and secured to the subline shaft 33.

The rotational number, or speed, of the main line shaft 32 is usually an integral multiple (such as twice) the rotational number N of the printing cylinders 11A to 15A.

The drive side frame 40 of the printing unit 13 accommodates a drive torque transmission mechanism for causing rotation of the printing cylinders 13A and blanket cylinders 13B. The rotation of the main line shaft 32 is transmitted through bevel gears 6A and 46B secured to the main line shaft 32 and gears 47 to 49 to the printing and blanket cylinders 13A and 13B of the printing unit 13.

Although not shown in FIG. 2, in the drive side frame of each of the other printing units 14 and 15 a similar drive torque transmission mechanism is provided, and thus the printing cylinders 14A and 15A and blanket cylinders 14B and 15B are rotated with the rotation of the main line shaft 32.

The main line shaft 32 in the bear box 41 is provided with an electromagnetic clutch 50. To the electromagnetic clutch 50 a sub-motor 52 is coupled via a belt-and-pulley assembly 51 (as shown by a phantom line).

The sub-motor 52 is provided for changing printing plates on the printing cylinders 13A to 15A of the printing units 13 to 15 coupled together by the main line shaft 32.

For carrying out printing by rotating the main line and sub-line shafts 32 and 33 with the main motor 31, the electromagnetic clutch 50 is decoupled. For carrying out plate change with the printing cylinders 13A to 15A of the printing units 13 to 15 by holding the main motor 31 stationary, the electromagnetic clutch 50 is coupled, and the main line shaft 32 is rotated by the sub-motor 52 for gentle movement and slight movement.

On the left side of the drive side frame 40 of the main line shaft 32 in FIG. 1, a rotary encoder 60 is provided via a belt-and-pulley assembly 63 (as shown by a phantom line). The rotary encoder 60 is provided for phase detection when effecting automatic or half-automatic plate change with the printing cylinders 13 A and 15 A in the printing units 13 to 15.

An end of a shaft 71 secured to the gear 43 in the gear box 41 is provided with a pulse generator 70.

The pulse generator 70 cooperate with pulse generators 150 and 151 to be described later to effect speed control when switching the printing units 11 and 12. The rotational number, or speed, of the shaft 71 with the pulse generator 70 mounted thereon, like the sub-line shaft 33, is usually equal to the rotational number N of the printing cylinders 11A to 15A.

The printing unit 11 is shown on the right side in FIG. 2, and the printing unit 12 at the center. These printing units 11 and 12 can be switched to be used alternatively for printing together with the other printing units 13 and 15. As will be described later in detail, the printing units 11 and 12 may not only be used alternatively but may also be used at the same time.

The printing units 11 and 12 have drive side frames 80 and 90 accommodating drive torque transmission mechanisms for rotating the printing cylinders 11A and 12A and blanket cylinders 11B and 12B. These drive torque transmission mechanisms have shafts 81 and 91 extending parallel to the sub-line shaft 33. The rotation of the shafts 81 and 91 is transmitted via bevel gears 82A, 82B and 92& 92B secured to the shafts 81 and 91 and gears 83 to 85 and 93 to 95 to the printing cylinders 11A and 12A and blanket cylinders 11B and 12B of the printing units 11 and 12.

The rotational number of the shafts 81 and 91 is equal to the rotational number of the main line shaft 32 and an integral multiple of (for instance twice) the rotational number N of the printing cylinders 11A to 15A.

The printing units 11 and 12 have drive side frames 80 and 90 provided with gear boxes 86 and 96. In the gear boxes 86 and 96, the shafts 81 AND 91 are coupled to the sub-line shaft 33.

The gear boxes 86 and 96 accommodate gears 87 and 97 secured to the shafts 81 and 91, gears 88 and 98 in mesh with the gears 87 and 97 and gears 89 and 99 in mesh with the gears 88 and 89 and coupled to the sub-line shaft 33 via one-point clutches 100 and 101 as first coupling/decoupling means.

Figure 3:
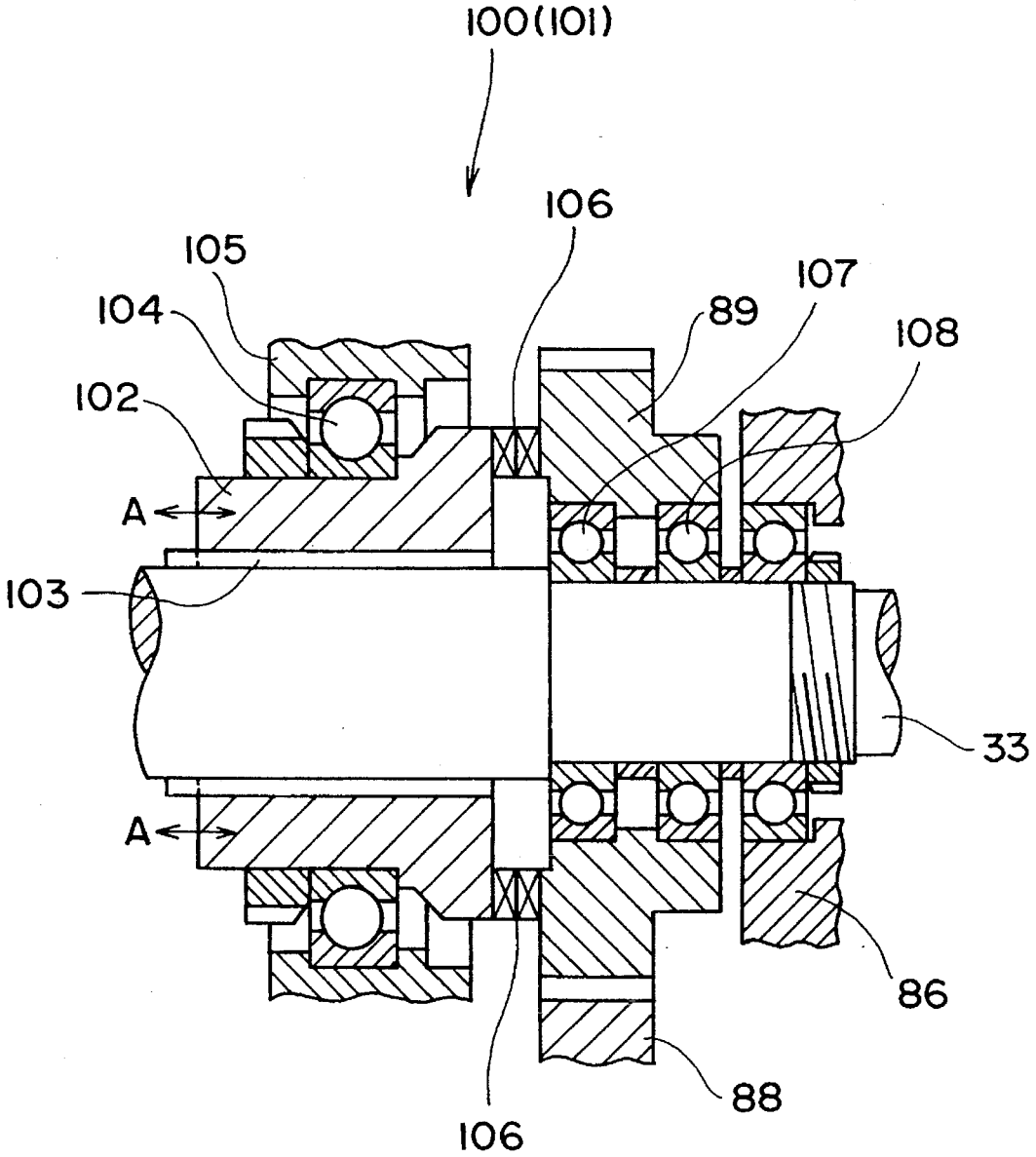
FIG. 3 is a fragmentary enlarged-scale sectional view showing an essential part (i.e., first coupling/decoupling means) of the same embodiment.

FIG. 3 is a detailed sectional view showing the one-point clutch 100. The one-point clutch 101 has the same construction.

Referring to FIG. 3, the one-point clutch 100 has a movable member 102 which is movable along the sub-line shaft 33. A slide sleeve member 103 is provided between the movable member 102 and the sub-line shaft 33, so that the movable member 102 is movable in directions of arrow A in FIG. 3 while it is rotated in unison with the sub-line shaft 33. The stroke of the movement is about 15 mm, for instance.

Another movable member 105 which is not rotatable, is provided on the outer periphery of the movable member 102 via a bearing 104.

The right side end surface of the movable member 102 in FIG. 3 is provided with a mesh section 106. The other side of the mesh section 106 is the left side end of the gear 89.

Bearings 107 and 108 are provided between the gear 89 and the sub-line shaft 33. The gear 89 and the sub-line shaft 33 are thus rotatable relative to each other.

In the mesh section 106, the side of the movable member 102 and the side of the gear 89 can be coupled to each other at a predetermined angle of opposition (one point). Thus, the phase adjustment of the printing cylinders 11A and 12A is made unnecessary.

When the one-point clutch 100 is switched to the coupled state, the movable member 105 is moved to the right in FIG. 3 to move the movable member 102 also to the right. Thus, the side of the movable member 102 and the side of the gear 89 in the mesh section 106 are brought into contact with and coupled to each other. In this state, the rotation of the sub-line shaft 33 is transmitted via the movable member 102 and the mesh section 106 to the gear 89.

When the one-point clutch 100 is switched to the decoupled state, the movable member 105 is moved to the let in FIG. 3 to move the movable member 102 also to the let. Thus, the side of the movable member 102 and the side of the gear 89 in the mesh section 106 are separated and decoupled from each other. In this state, the rotation of the sub-line shaft 33 is transmitted only up to the movable member 102, and there is no transmission of rotation between the gear 89 and the sub-line shaft 33.

With such coupling and decoupling of the one-point clutches 100 and 101, the printing units 11 and 12 are switched to alternately join the other printing units 13 and 15 for multi-color printing.

For example, when using the printing unit 11 while holding the printing unit 12 stationary, the one-point clutch 100 is switched to the coupled state to drive the printing unit 11 from the main motor 31 via the sub-line and main line shafts 33 and 32, while the one-point clutch 101 is switched to the decoupled state to separate the printing unit 12 from the rotation of the sub-line shaft 33, i.e., the main motor 31.

When using the printing unit 12 while holding the printing unit 11 stationary for printing, the one-point clutch 100 is switched to the decoupled state while the one-point clutch 101 is switched to the coupled state.

Referring back to FIG. 2, the shafts 81 and 91 in the gear boxes 86 and 96 are provided with electromagnetic clutches 120 and 121 as second coupling/decoupling means. Double electromagnetic clutches 124 and 125 are coupled via belt-and-pulley assemblies 122 and 123 (as shown by phantom lines) to the electromagnetic clutches 120 and 121. Sub-motors 128 and 129 as independent drive means are coupled via speed reduction units 126 and 127 to the double electromagnetic clutches 124 and 125.

The sub-motors 128 and 129 are provided for driving the Printing units 11 and 12 independently when the printing units 11 and 12 are separated from the rotation of the main motor 31 with the one-point clutches 100 and 101 switched to the decoupled state.

The electromagnetic clutches 120 and 121 are provided for turning on and off the transmission of rotation between the sub-motors 128 and 129 and the printing and blanket cylinders 11A, 12A and 11B, 12B.

The double electromagnetic clutches 124 and 125 are capable of switching between a high speed side (left side in FIG. 2) for synchronization control when the printing units 11 and 12 are switched for alternate use as will be described later and a low speed side (right side in FIG. 2) for gentle movement or slight movement when changing printing plates. When the double electromagnetic clutches 124 and 125 are switched to the high speed side, the rotation of the sub-motors 128 and 129 is not speed reduced in the speed reduction units 126 and 127, and transmitted via belt-and-pulley assemblies 130A and 131A (as shown by phantom lines) provided on the left side of the speed reduction units 126 and 127 in FIG. 2 and coupling sections 124A and 125A on the left side of the double electromagnetic clutches 124 and 125 in FIG. 2 to the shafts of the double electromagnetic clutches 124 and 125 and thence via the belt-and-pulley assemblies 122 and 123 to the shafts 81 and 91. When the double electromagnetic clutches 124 and 125 are switched to the low speed side, the rotation of the sub-motors 128 and 129 is speed reduced in the speed reduction units 126 and 127, and transmitted via belt-and-pulley assemblies 130B and 131B provided on the right side of the speed reduction units 126 and 127 in FIG. 2 and coupling sections 124B and 125B on the fight side of the double electromagnetic clutches 124 and 125 in FIG. 2 to the shafts of the double electromagnetic clutches 124 and 125 and thence via the belt-and-pulley assemblies 122 and 123 to the shafts 81 and 91.

To the left side of the drive side frames 80 and 90 of the shafts 81 and 91 in FIG. 2, rotary encoders 140 and 141 are coupled via brakes 142 and 143 and belt-and-pulley assemblies 144 and 145 (as shown by phantom lines).

The rotary encoders 140 and 141 are provided for phase detection when performing automatic or half-automatic plate change of the printing cylinders 11A and 12A of the printing units 11 and 12.

The shafts 152 and 153 secured to the gears 88 and 89 in the gear boxes 86 and 96 have their ends provided with pulse generators 150 and 151.

The pulse generators 150 and 151 cooperate with the pulse generator 70 noted before for speed control when switching the printing units 11 and 12. The rotational number of the shafts 152 and 153 with the pulse generators 150 and 151 mounted thereon, like the sub-line shaft 33, is equal to the rotational number N of the printing cylinders 11A and 15A.

A sequencer 155 is coupled to the pulse generators 70, 150 and 151. The sequencer 155 receives detection signals from the pulse generators 70, 150 and 151 to grasp the rotational speed of the printing cylinders 11A and 12A of the printing units 11 and 12 and the rotational number of the printing cylinders 13A and 15A of the printing units 13 to 15. While performing vector inverter control of the sub-motors 128 and 129 it increases the rotational speed of the printing cylinders 11A and 12A of the printing units 11 and 12 from the stationary state to a printing speed into synchronization to the printing cylinders 13A to 15A of the printing units 13 to 15 after a predetermined sequence.

At this time, the sequencer 155 controls the rotational number of the printing cylinders 11A and 12A of the printing units 11 and 12 under synchronization control to about 8 to 10 rpm with respect to the rotational number (printing speed) of the printing cylinders 13A to 15A of the printing units 13 to 15 or to about 1.3% of the printing speed (corresponding to 10 rpm if the printing speed is 750 rpm). These numerical values are examples of the synchronization control and not limitative.

The pulse generators 70, 150 and 151 and the sequencer 155 form rotational control means 156.

Referring back to FIG. 1, the priming units 11 and 12 are capable of two different ways of passing the web 16.

One of the ways is a bent web passage, in which the web 16 is passed in a zig-zag fashion in the sectional view (as shown by solid line in FIG. 1). In the bent web passage, the three printing units 13 to 15 are used for base printing without plate change, while the other printing units 11 and 12 are used for plate change printing, that is, they are used alternately with shop name plates mounted on them. This way of web passage is suited for carrying out plate change printing continuously with the printing machine 10.

The other way is a straight web passage, in which the web 16 is passed straight in the sectional view (as shown by phantom line in FIG. 1). This way of web passage is suited for printing by using all the five printing units 11 to 16, for instance with a feature of gold or silver color added to the usual four-color printing. The straight web passage is the usual way of web passage, in which the web 16 passed through the five printing units 11 to 15 is straight over the entire printing units.

Guide rollers 200 and 201 for guiding the web 16 are provided on the upstream side (i.e., fight side in FIG. 1) of the blanket cylinders 11B and 12B of the printing units 11 and 12. Other guide rollers 202 and 203 are provided on the downstream side (i.e., left side in FIG. 1) of the blanket cylinders 11B and 12B and in the neighborhood of the inlets of the printing units 12 and 13. Suitably, a perforator is wound on each of the guide rollers 200 to 203 to prevent contamination of the printing surface.

Figure 4:
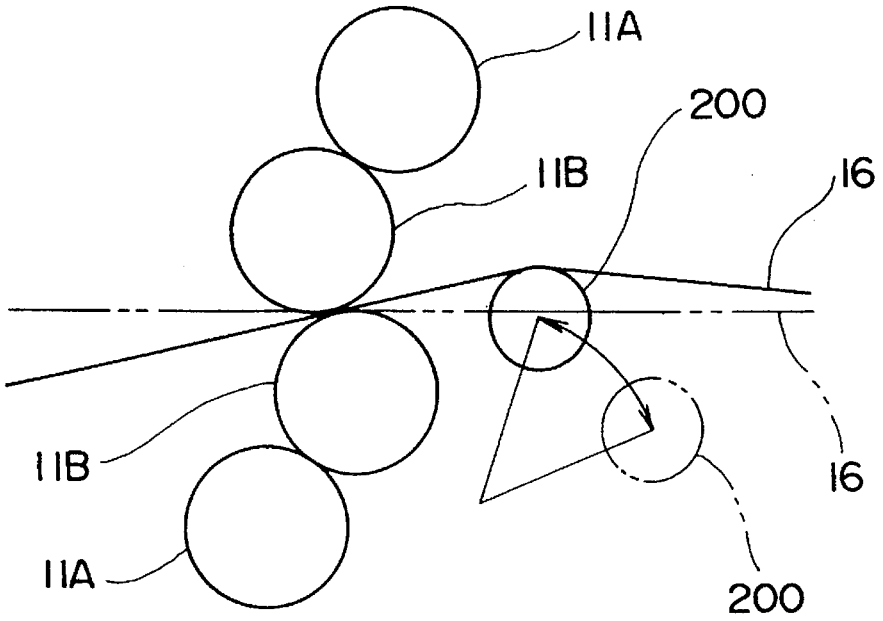
FIG. 4 is an enlarged-scale view showing an essential part (i.e., guide rollers and the neighborhood thereof) of the same embodiment.

FIG. 4 shows the structure of the guide roller 200 in detail. The guide roller 201 has the same structure.

The guide roller 200 is mounted in a swinging fashion. In its bent web passage disposition, it is found in a left upper position in FIG. 4 (as shown by solid line). In this disposition, the web 16 is passed in the bent web passage noted above, that is, it is passed to be directed in a direction substantially perpendicular to a line connecting the centers of the two, i.e., upper and lower, blanket cylinders 11B.

In its straight web passage disposition, the guide roller 100 is found at a right lower position in FIG. 4 (as shown by phantom line). In this case, the web 16 is passed in the straight web passage as noted above.

Further, as shown in FIG. 1, in the bent web passage the web 16 is guided by the guide rollers 202 and 203 such that it passes by the underside of the guide rollers 202 and 203. In the straight web passage, on the other hand, the web 16 passes over the guide rollers 202 and 203 without contact therewith.

With the guide rollers 202 and 203 made to be capable of switching in the above way, the bent web passage and straight web passage of the web 16 can be readily switched without removal of the continuous web 16.

Figure 5:
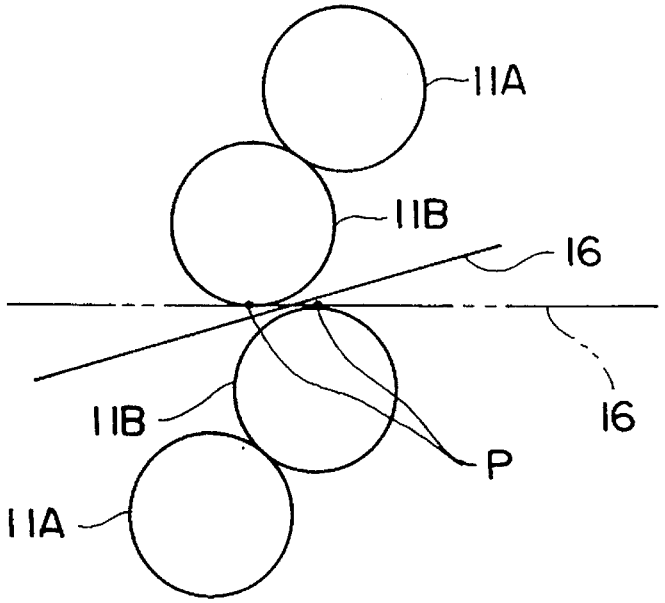
FIG. 5 is an enlarged-scale view for explaining blanket cylinders in the same embodiment with the guide rollers in a straight web passage disposition.

As shown in FIG. 5, the guide rollers 200 to 203 are disposed in a staggered fashion to prevent contact of the web 16 with the two, i.e., upper and lower, blanket cylinders 11B, which are disposed in a staggered fashion in the direction of progress of the web 16, when the blanket cylinders 11B are brought to a spaced-apart state.

Since the two blanket cylinders 11B are disposed in a staggered fashion, even when they are brought to the spaced-apart state (i.e., state shown in FIG. 5), in the straight web passage (as shown by phantom line in FIG. 5) the web 16 and the blanket cylinders 11B touch one another at points P in FIG. 5. In this state, the plate change operation can not be carried out with the web 16 held running. Accordingly, with the provision of the guide rollers 200 to 203 the web 16 is passed in the bent web passage (as shown by solid line in FIG. 5) to prevent the contact of the web 16 at the points P.

Referring back to FIG. 2, the sub-line shaft 33 is provided at the positions corresponding to the printing units 11 and 12 with electromagnetic clutches 204 and 205.

The electromagnetic clutches 204 and 205 are provided for adjustment for printing cylinder phase deviation of the printing units 11 and 12 that is produced at the time of the switching of the bent web passage and the straight web passage of the web 16 due to the difference of the web pass length between these ways of web passage. The phase adjustment at this time is done by utilizing the rotary encoders 60, 140 and 141 which are provided for the automatic or half-automatic plate change noted before, and the electromagnetic clutches 204 and 205 are coupled when the phase coincidence is obtained.

The electromagnetic clutches 204 and 205 and the rotary encoders 60, 140 and 141 form phase adjustment means.

This embodiment permits continuous plate change printing of a shop name or the like without stopping the printing machine 10.

First, a substitute printing plate of a shop name or the like to be used for printing is mounted on one of the two switchable printing units 11 and 12 (here the printing unit 11 being assumed), then the web 16 is passed by bent web passage through both the printing units 11 and 12, and printing is performed with a total of four printing units, i.e., three printing units 13 to 15 for base printing and the printing unit 11.

At this time, the one-point clutch 100 is coupled, while the one-point clutch 101 is decoupled. Also, the blanket cylinders 11B of the printing unit 11 are in the contact state (i.e., printing state), while the blanket cylinders 12B of the printing unit 12 is in the out-of-contact state. The electromagnetic switches 120 and 121 are both held decoupled, and the sub-motors 128 and 129 are both held stationary. The main line and sub-line shafts 32 and 33 are driven for rotation from the main motor 31 to drive the switchable printing unit 11 and the printing units 13 to 15.

During the printing with the switchable printing unit 11 and the printing units 13 to 15, an operation of changing the printing plate of a shop name or the like on the stationary printing unit 12 is done to be ready for the next printing by starting the sub-motor 129 with the electromagnetic clutch 121 coupled and the double electromagnetic clutch on the low speed side while having the web 16 in the running state.

Then, the state of printing with the switchable printing unit 11 and the printing units 13 to 15 is switched over to the state of printing with the switchable printing unit 12 and the printing units 13 to 15.

At this time, the printing unit 11 is separated from the driving by the main motor 31 by switching the one-point clutch 100 for the printing unit 11 during printing from the coupled state to the decoupled state, and it is rendered into the non-printing state by switching its blanket cylinders 11B from the contact state to the out-of-contact state. Then, the printing unit 11 is stopped by braking it.

Meanwhile, the double electromagnetic clutch 125 is switched to the high speed side, the electromagnetic clutch 121 is coupled, and the sub-motor 129 is started for synchronization control of the stationary printing unit 12 by the sequencer 155. When the synchronization is obtained, the one-point clutch 101 for the printing unit 12 is switched from the decoupled state over to the coupled state, and the printing unit 12 is driven by the main motor 31. At the same time, the electromagnetic clutch 121 is decoupled, and the sub-motor 129 is stopped. Then, the blanket cylinders 12B of the printing unit 12 are switched from the out-of-contact state over to the contact state to bring about the printing state of the printing unit 12.

The operation of switching of the printing unit 11 over to the printing unit 12 is done while the web 16 is held running.

The converse switching operation, that is, the operation of switching the state of printing with the switchable printing unit 12 and the printing units 13 to 15 over to the state of printing with the switchable printing unit 11 and the printing units 13 to 15, is done in the same way except the operations of the switchable printing units 11 and 12 are conversed.

After the switching of the printing units 11 and 12 has been completed, printing is performed with the total of four Printing units, i.e., the three printing units 13 to 15 for base printing and the printing unit 12.

At this time, the one-point clutches 100 and 101 and the blanket cylinders 11B and 12B are in the converse state to the state of printing with the printing unit 11 noted above.

During the printing with the switchable printing unit 12 and the printing units 13 to 15, again the operation of changing the printing plate of a shop name or the like on the stationary printing unit 11 is done to be ready for the next printing.

The switching of the printing units 11 and 12 for alternate use thereof can be done while the web 16 is running, and it is possible to obtain plate change printing without stopping the printing machine 10.

During the printing with the printing unit 11, at the time of the switching of the printing units 11 and 12 and during the printing with the printing unit 12, the web 16 is in the state of the bent web passage in both the printing units 11 and 12 at all times.

With the above printing with alternate use of the printing units 11 and 12, in this embodiment five-color printing is done by using all the printing units 11 to 15 in the following procedure.

When carrying out five-color printing by adding a feature of gold color, silver color, etc. to the ordinary four-color printing, in the printing units 11 and 12 the guide rollers 200 and 201 are held in the straight web passage disposition to pass the web in the straight web passage. That is, the web 16 is passed straight over the five printing units 11 to 15.

At this time, the one-point clutches 100 and 101 are both coupled, and the five printing units 11 to 15 are all driven from the main motor 31, while the blanket cylinders 11B and 12B are in the contact state (i.e., printing state). The electromagnetic clutches 120 and 121 are decoupled, and the sub-motors 128 and 129 are held stationary.

When the printing units 11 and 12 are not operated by switching operation as above, the blanket cylinders 11B and 12B are not switched between the contact and out-of-contact states. Thus, it is desirable in this case to pass the web 16 by straight web passage. However, it is possible as well to pass the web 16 by straight web passage for five-color printing.

With the embodiment as described above, the following effects are obtainable.

Since the printing units 11 and 12 are switchable printing units, they can be switched for alternate use, thus obtaining continuous operation while effecting plate changes. That is, the plate change operation for plate change printing of a shop name or the like can be carried out without stopping the printing machine 10.

It is thus possible to reduce paper loss at the time of the plate change for changing the shop name or the like to be printed. Printing cost thus can be reduced. In addition, time for restoration to the printing state after stopping can be eliminated, thus permitting printing efficiency improvement.

As a specific example, continuous printing was performed with this embodiment of the printing machine 10. No stationary time of the printing machine was involved. The paper loss at the time of the switching of the printing units 11 and 12 was about 115 sheets (corresponding to about 9 seconds with a printing cylinder rotational number of 750 rpm). In contrast, when the conventional printing machine was once stopped and restored to the printing state after plate change, the stationary time involved was about 10 minutes, and the paper loss at the time of the rising was about 600 sheets.

As a further effect, the rotational control means 156 can synchronize the printing unit 11 (or 12) that has been stationary to the individual printing units in printing operation at the printing speed. Thus, it is possible to realize the switching of the printing units 11 and 12 without stopping the printing machine 10 and also with the web 16 held in the running state. It is thus possible to obtain the reduction of the printing cost and improvement of the printing efficiency as noted above.

Figure 6:
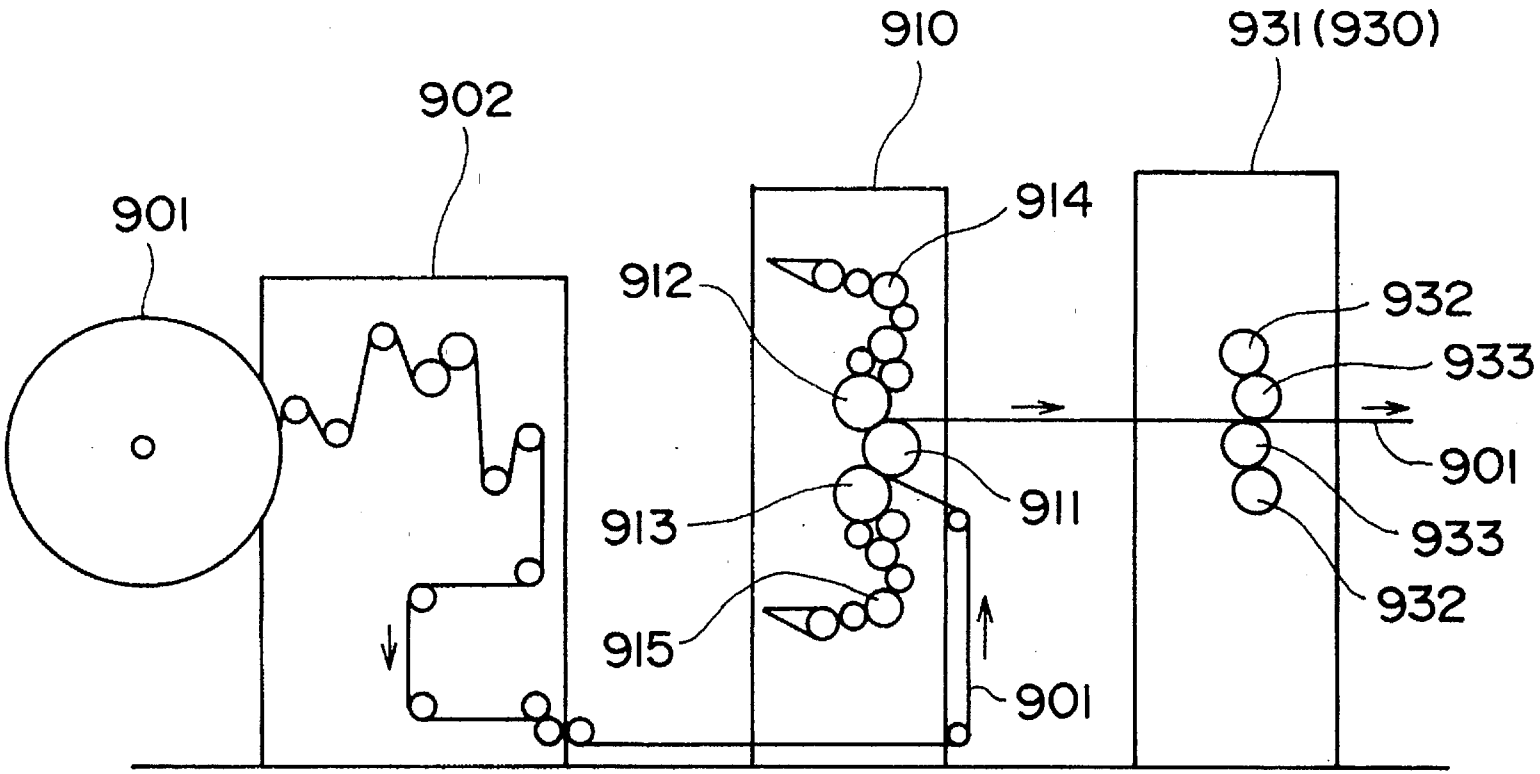
FIG. 6 PRIOR ART
FIG. 6 is a schematic view showing a prior art structure.

Further, since the printing units 11 and 12, unlike the in-printer 910 noted above as shown in FIG. 6, are not exclusive plate change printers, and they can be used at the same time for five-color printing. The printing machine 10 thus has excellent adaptability.

Further, unlike the in-printer 910, there is no restriction on single side printing only. In this aspect, the printing machine 10 may have excellent adaptability.

Still further, unlike the in-printer 910, the printing does not use any flexographic plate, and thus there is no need of providing any equipment for producing flexographic plates. Besides, it is possible to eliminate reduction of the printing quality with use of flexographic plate.

Yet further, since the one-point clutches 100 and 101 are provided as the first coupling/decoupling means for coupling and decoupling the printing units 11 and 12 with respect to the main motor 31, it is possible to make ready phase adjustment when switching the printing units 11 and 12 for alternate use.

Further, since the guide rollers 200 to 203 are provided upstream and downstream the blanket cylinders 11B and 2B of the printing up its 11 and 12 for passing the web 15 by bent web passage with the guide of these guide rollers 200 to 203, it is possible to prevent the contact of the web 16 with the blanket cylinders 11B and 12B when the blanket cylinders 11B and 12B are rendered to be in the out-of-contact state.

Thus, it is possible to perform the plate change operation with the web 16 held running and readily and reliably realize continuous printing.

Further, since the guide rollers 200 and 201 are capable of disposition switching, the web 16 can be passed by straight web passage with the guide rollers 200 and 201 in the straight web passage disposition, and it is thus possible to obtain five-color printing with all the printing units 11 to 15.

Further, with the guide rollers 202 and 203 capable of disposition switching, the bent web passage and straight web passage can be readily switched one over to the other without removal of the web 16.

Further, with the electromagnetic clutches 204 and 205 provided on the sub-line shaft 33, it is possible to make ready adjustment concerning the phase difference at the time of the switching of the bent web passage and straight web passage of the web 16.

The above embodiment of the invention is by no means limitative, and the invention covers other structures which can attain the object of the invention. For example, the following modifications are possible.

In the above embodiment, the phase adjustment means to be used when switching the bent web passage and straight web passage of the web 16 was formed by the electromagnetic clutches 204 and 205 and the rotary encoders 60, 140 and 141. However, it is also possible to provide friction couplings with notch or the like in lieu of the electromagnetic clutches 204 and 205 on the sub-line shaft 33 and permit suitable adjustment of the coupling state of the couplings such as to obtain coincidence of the printing cylinder phase.

Further, while in the above embodiment the rotary encoders 60, 140 and 141 were provided for automatic or half-automatic switching, they are not needed when carrying out the plate change manually. In this case, the phase adjustment means for the switching between the bent web passage and straight web passage of the web 16 may be the friction couplings with notch as noted above or the like.

In the above embodiment the phase adjustment means is provided for phase adjustment at the time of the switching of the bent web passage and straight web passage of the web 16. However, by setting the difference between the pass length of the web 16 in the bent web passage and the pass length of the web 16 in the straight web passage to be a length corresponding to one excursion along the outer periphery of the printing cylinder, no phase adjustment is necessary at the time of the switching of the bent web passage and straight web passage, and it is possible to dispense with the phase adjustment means such as the electromagnetic clutches 204 and 205, friction couplings with notch, etc.

Further, where the web 16 is not passed by the straight web passage, for instance where printing is done only by alternately using the printing units 11 and 12 by switching or where the web 16 is passed by the bent web passage even for five-color printing with all the printing units 11 to 15, the guide rollers 200 and 201 may not be capable of disposition switching.

Further, while in the above embodiment the electromagnetic clutches 120 and 121 and the double electromagnetic clutches 124 and 125 were provided between the printing cylinders 11A and 12A of the printing units 11 and 12 and the sub-motors 128 and 129, if the double magnetic clutches 124 and 125 can be brought to a neutral state (not coupled to either high or low speed side), the electromagnetic clutches 120 and 121 may be dispensed with. In this case, the double electromagnetic clutches 124 and 125 constitute the second coupling/decoupling means. Where the sub-motors 128 and 129 can cope with a wide rotation range from the high speed to the low speed rotation, the double electromagnetic clutches 124 and 125 may be dispensed with.

Further, while in the above embodiment the one-point clutches 100 and 101 as the first coupling/decoupling means were provided on the sub-line shaft 33 at the same rotational number N as the printing cylinders 11A and 15A this is by no means limitative. That is, the one-point clutches 100 and 101 may be provided at any locality in the drive torque transmission path from the main motor 31 to each of the switchable printing units 11 and 12 so long as the locality is rotated at the same rotational number N as the printing cylinders 11A to 15A.

In the above embodiment, the sub-line shaft 33 which stripped the two switchable printing units 11 and 12 was provided to provide the locality rotatable at the same rotational number N as the printing cylinders 11A to 15A through conversion of the rotational number of the main line shaft 32. However, such sub-line shaft 33 may not be provided. Instead, it is possible to provide a locality rotatable at the same rotational number N as the printing cylinders 11A to 15A between the main line shaft 32 and each of the switchable printing units 11 and 12 and install each of the one-point clutches 100 and 101 at such a locality. Suitably, however, the sub-line shaft 32 is provided. Doing so permits conversion of the rotational number of the main line shaft 32 to the same rotational number N as that of the printing cylinders 11A to 15A at a single position.

Further, while in the above embodiment the common plate change sub-motor 52 is provided for the printing units 13 to 15 for base printing, it is possible to make these non-switchable printing units 13 to 15 capable of independent driving by providing an independent drive sub-motor for each of them.

Further, while the above embodiment of the printing machine 10 has five printing units 11 to 15 including two switchable printing units 11 and 12, the switching type continuously operative printing machine according to the invention may any number of printing units so long as it has a plurality of printing units; for instance, it may have two to four or six or more printing units.

The number of switchable printing units among the plurality of printing units that are provided need not be two as in the above embodiment, and it may be three or more. Where three switchable printing units are provided, they may be used alternatively one after another for printing, while holding the other two printing units stationary for preparations (such as plate change) for the next printing. As an alternative, two printing units may be used at a time, while the remaining one may be held stationary for preparations (such as plate change) for the next printing.

Moreover, while the above embodiment of the printing machine 10 was a web offset perfect printing press, the switching type continuously operative printing machine according to the invention may as well be a printer for sheet printing or a printer for single-side printing.

As has been described in the foregoing, in the printing machine according to the invention two or more switchable printing units are provided such as to be suitably switched by using the first coupling/decoupling means, independent drive means, second coupling/decoupling means and rotational control means for continuous printing while the continuous printing web is held running. It is thus possible to realize continuous plate change printing without stopping the printing machine. Thus, it is possible to permit highly efficient, high quality printing, reduce paper loss accompanying the plate change and reduce the cost of printing, as well as permitting double-side printing.

What is claimed is:

1. A switching type continuously operative printing machine comprising a plurality of printing units capable of printing on continuous forms and collective drive means for collectively driving said plurality of printing units, said plurality of printing units including at least two switchable printing units that are switchable between independent or collective operation while other printing units of said plurality of printing units are in continuous collective operation, each said switchable printing unit comprising:

first coupling/decoupling means for coupling and decoupling the collective drive means and each of said switchable printing units;

independent drive means for independently driving each of said switchable printing units;

second coupling/decoupling means for coupling and decoupling the independent drive means and each of said switchable printing units; and rotational control means for synchronizing a rotational speed of said independent drive means and a rotational speed of said collective drive means to one another at a printing speed so that in when a switchable printing unit of said at least two switchable printing units is decoupled from said collective drive means and is coupled to said independent drive means, the rotational speed of said independent drive means is equalized to the printing speed of said collective drive means before decoupling said switchable printing unit from said independent drive means and coupling said switchable printing unit to said collective drive means;

upper and lower blanket cylinders disposed in staggered fashion with respect to a direction of progress of a continuous printing web such as to pinch the continuous printing web between the upper and lower blanket cylinders; and guide rollers provided at upstream and downstream positions, with respect to the direction of progress, from the blanket cylinders, said guide rollers being moveable between a bent web passage position in which said guide rollers guide the continuous printing web so that the continuous printing web passes through the guide rollers and between the upper and lower blanket cylinders in a direction perpendicular to a line connecting centers of the upper and lower blanket cylinders so that the continuous printing web does not contact the upper and lower blanket cylinders of nonoperating switchable printing units, and a straight web passage position in which said guide rollers guide the continuous printing web so that the continuous printing web passes between the upper and lower blanket cylinders of adjacent switchable printing units in a straight line, said guide rollers being moveable between a bent web passage position and the straight web passage position while the continuous printing web is running.

2. The switching type continuously operative printing machine according to claim 1, wherein the plurality of printing units are five printing units including two switchable printing units.

3. The switching type continuously operative printing machine according to claim 1, wherein each said first coupling/decoupling means is a one-point clutch provided on a portion of a drive torque transmission path extending from the collective drive means to each printing unit, said collective drive means being rotated at a rotational speed that is the same as a rotational speed of the blanket cylinders, the one-point clutch being capable of being coupled at a predetermined phase.

4. The switching type continuously operative printing machine according to claim 1, wherein the difference between a length of pass of the continuous printing web in the bent web passage position of the guide rollers and the length of the pass of the continuous printing web in the straight web passage position of the guide rollers is a length corresponding to one excursion along the outer periphery of each of the blanket cylinders.

5. The switching type continuously operative printing machine according to claim 1, further comprising phase adjustment means provided on an intermediate position of a drive torque transmission path from the collective drive means to each switchable printing unit, the phase adjustment means being for adjusting a phase difference between the blanket cylinders when the guide rollers are in the bent web passage disposition and in the straight web passage disposition.

6. The switching type continuously operative printing machine according to claim 1, wherein said rotational control means includes:

a pulse generator provided in at least each switchable printing unit for emitting a detection signal for indicating a rotational speed of the blanket cylinders in the printing unit: and a sequencer connected to the pulse generators to receive detection signals therefrom and control the independent drive means in a predetermined sequence so as to increase the rotational speed of the printing cylinders of each switchable printing unit from the stationary state up to a printing speed.

7. The switching type continuously operative printing machine according to claim 1, wherein the collective drive means includes:

a sub-line shaft coupling each switchable printing unit;

a main line shaft connected to the sub-line shaft and coupling the other printing units than the switchable printing units; and a main motor connected to the main line shaft.

8. The switching type continuously operative printing machine according to claim 1, which further comprises a double electromagnetic clutch provided on a drive torque transmission path between each independent drive means and each switchable printing unit, the double electromagnetic clutch being switchable between a high speed side position in which a rotational output of each said independent drive means is transmitted, without reduction, first to a first coupling section of each said double electromagnetic clutch via a first belt and pulley assembly and second to each said switchable printing unit via a second belt and pulley assembly and a low speed side position in which a rotational output of each said independent drive means is reduced by a speed reduction unit and is then transmitted first to a second coupling section of each said double electromagnetic clutch via said first belt and pulley assembly and second to each said switchable printing unit via a second belt and pulley assembly, the double electromagnetic clutch being switched to the high speed side for synchronization of the independent drive means and the collective drive means and to the low speed side to provide slow operation of the switchable printing unit to permit changing of printing plates.

* * * * *